US008839980B2

(12) United States Patent
Baines

(10) Patent No.: US 8,839,980 B2
(45) Date of Patent: Sep. 23, 2014

(54) BATH AND SHOWER CORNER CADDY

(71) Applicant: Maytex Mills, Inc., New York, NY (US)

(72) Inventor: David Baines, Bedford, NY (US)

(73) Assignee: Maytex Mills, Inc., New York, NY (US)

( * ) Notice: Subject to any disclaimer, the term of this patent is extended or adjusted under 35 U.S.C. 154(b) by 0 days.

(21) Appl. No.: 13/723,435

(22) Filed: Dec. 21, 2012

(65) Prior Publication Data

US 2013/0161329 A1 Jun. 27, 2013

Related U.S. Application Data

(60) Provisional application No. 61/579,838, filed on Dec. 23, 2011.

(51) Int. Cl.
*A47K 5/02* (2006.01)
*A47K 3/28* (2006.01)

(52) U.S. Cl.
CPC ..... *A47K 3/281* (2013.01)
USPC ..... 220/481; 220/476; 248/220.1; 211/90.03

(58) Field of Classification Search
CPC ..... A47K 3/281; A47B 96/281
USPC ..... 220/476, 780, 483, 481, 480, 482, 478; 248/220.1, 205.4, 205.3, 225.11, 248/223.41, 200.1; D6/525; 108/152, 42; 4/559, 574.1, 576.1, 605, 611; 211/90.03, 90.01, 87.01, 106, 181.1, 211/133.3, 133.2, 133.5
See application file for complete search history.

(56) References Cited

U.S. PATENT DOCUMENTS

| | | | | | |
|---|---|---|---|---|---|
| 975,619 | A * | 11/1910 | Hollander | ..... | 108/42 |
| 1,325,143 | A * | 12/1919 | Conterio | ..... | 108/42 |
| 4,555,082 | A | 11/1985 | Sack et al. | | |
| 4,708,310 | A | 11/1987 | Smith | | |
| 5,014,860 | A | 5/1991 | Emery | | |
| 5,154,384 | A | 10/1992 | Owens | | |
| 5,169,116 | A * | 12/1992 | Bergetz | ..... | 248/680 |
| D364,767 | S | 12/1995 | McLinden | | |
| 5,657,954 | A | 8/1997 | Emery et al. | | |
| D407,934 | S | 4/1999 | Wojtowicz et al. | | |
| D408,185 | S | 4/1999 | Hofman | | |
| D444,017 | S | 6/2001 | Walker | | |
| 6,431,386 | B1 | 8/2002 | Hofman et al. | | |
| 6,467,636 | B1 | 10/2002 | Schaefer | | |
| D472,747 | S | 4/2003 | Walker | | |
| D472,749 | S | 4/2003 | Walker | | |
| D475,561 | S | 6/2003 | Suero, Jr. | | |
| D475,562 | S | 6/2003 | Suero, Jr. | | |
| D509,361 | S | 9/2005 | Suero, Jr. | | |
| D513,142 | S | 12/2005 | Suero, Jr. | | |
| 7,802,766 | B2 * | 9/2010 | Thompson | ..... | 248/220.1 |
| 8,020,820 | B2 | 9/2011 | Thompson | | |

(Continued)

*Primary Examiner* — Mickey Yu
*Assistant Examiner* — Allan Stevens
(74) *Attorney, Agent, or Firm* — Robert P. Lenart, Esq.; Pietragallo Gordon Alfano Bosick & Raspanti, LLP

(57) ABSTRACT

A corner caddy includes a basket assembly and a bracket configured to be coupled to the basket assembly wherein the bracket includes a spreader, a first contact member pivotally connected to a first end of the spreader, a second contact member pivotally connected to a second end of the spreader, a first adhesive positioned adjacent to an outer surface of the first contact member, and a second adhesive positioned adjacent to an outer surface of the second contact member.

15 Claims, 8 Drawing Sheets

(56) References Cited

U.S. PATENT DOCUMENTS

D652,237 S 1/2012 Cittadino et al.
D653,067 S 1/2012 Cittadino et al.
8,453,982 B2 * 6/2013 Baruch ..... 248/220.1

* cited by examiner

BATH AND SHOWER CORNER CADDY

CROSS-REFERENCE TO A RELATED APPLICATION

This application claims the benefit of U.S. Provisional Patent Application Ser. No. 61/579,838, filed Dec. 23, 2011, and titled "Bath And Shower Corner Caddy", which is hereby incorporated by reference.

BACKGROUND

Bath or shower caddies are commonly used to hold bathing accessories. In order to install a conventional bath or shower corner caddy, one must either drill into the walls of the bath or shower, or use suction cups. Drilling results in damage to the bath or shower stall, while suction cups can lose suction, eventually causing the caddy to disengage from the wall.

SUMMARY

A corner caddy includes a basket assembly and a bracket configured to be coupled to the basket assembly wherein the bracket includes a spreader, a first contact member pivotally connected to a first end of the spreader, a second contact member pivotally connected to a second end of the spreader, a first adhesive layer adjacent to an outer surface of the first contact member, and a second adhesive layer adjacent to an outer surface of the second contact member.

DETAILED DESCRIPTION

Figure 1:
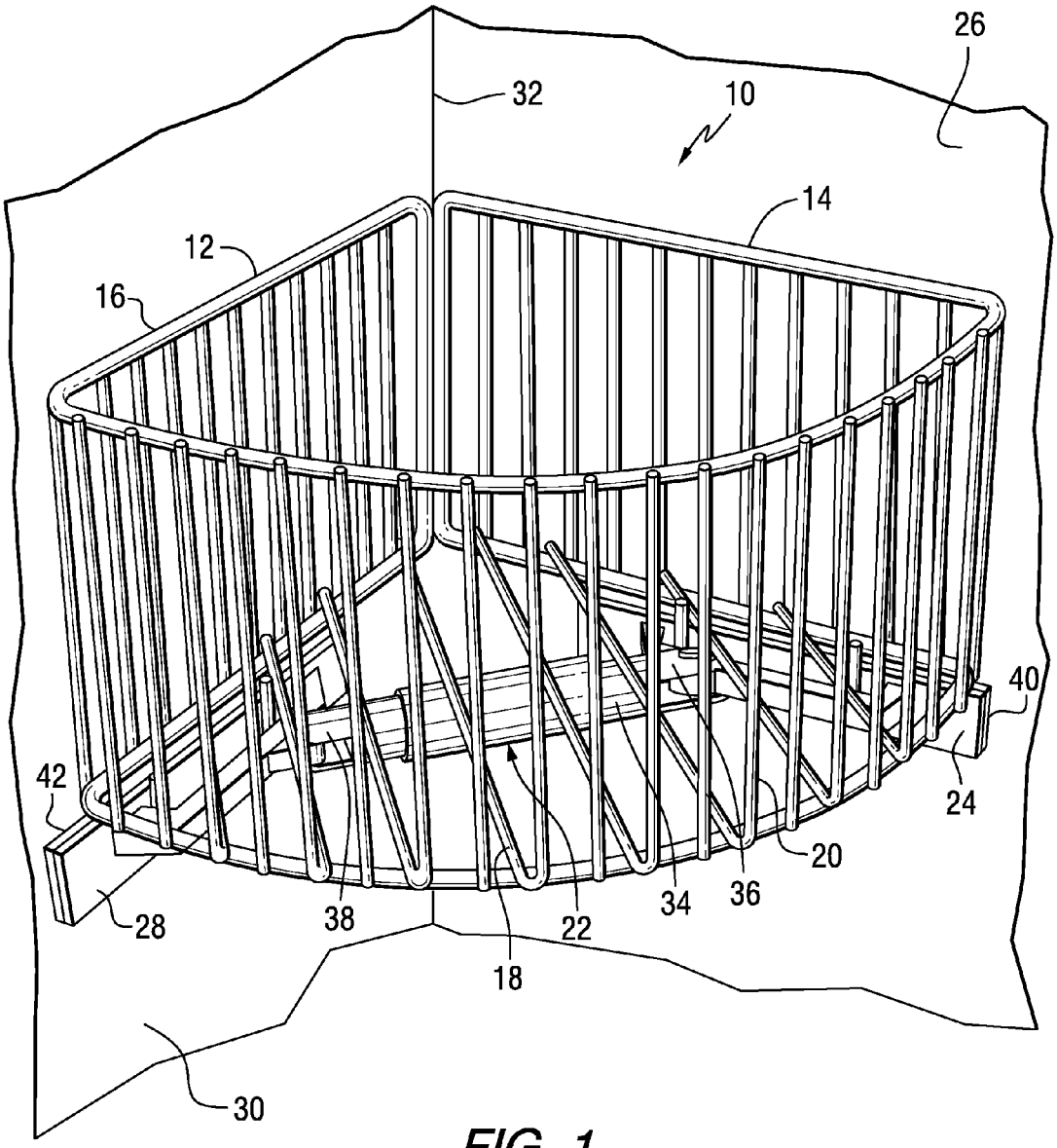
FIG. 1 is a perspective view of an embodiment of the invention mounted between two walls.

FIG. 1 is a perspective view of a caddy 10 constructed in accordance with an embodiment of the invention. In this embodiment, the caddy includes a wire frame basket 12 including a first side 14, a second side 16 positioned at substantially a right angle with respect to the first side, a bottom 18 and a curved front portion 20. The basket is supported by a bracket 22 that includes a first contact member 24 configured to be positioned adjacent to a first supporting surface or wall 26 and a second contact member 28 configured to be positioned adjacent to a second supporting surface or wall 30. In FIG. 1, the walls are shown to be positioned at substantially a right angle with respect to each other to form a corner 32. A tightening mechanism, referred to as a spreader or expansion member, 34 extends between the contact members. A first end 36 of the spreader is pivotally connected to the first contact member 24 and a second end 38 of the spreader is pivotally connected to the second contact member 28. A first adhesive, which in this embodiment comprises a first resilient adhesive pad 40, is positioned on an outer surface of the first contact member 24 such that the first resilient adhesive pad is positioned adjacent to the first wall 26. A second adhesive, which in this embodiment comprises a second resilient adhesive pad 42 is positioned on outer surface of the second contact member 28 such that the second resilient adhesive pad is positioned adjacent to the second wall 30. The adhesive can be an oil based adhesive similar to an adhesive used to affix devices to automobile windshields.

Figure 2:
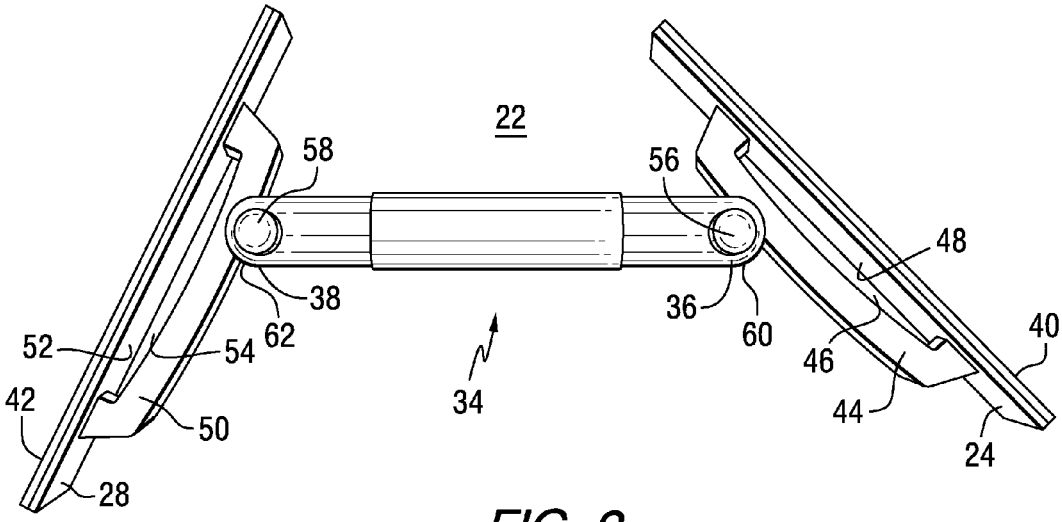
FIG. 2 is a top view of the support bracket of the embodiment of FIG. 1.

FIG. 2 is a top view of the support bracket 22. In this view, the first contact member is shown to include a projection 44, extending from an inner surface of the first contact member and forming a slot 46 between the projection and the inner surface 48 of the first contact member. The second contact member is shown to include a projection 50 extending from an inner surface 52 of the second contact member and forming a slot 54 between the projection and the inner surface of the second contact member. The spreader 34 is connected between pins 56 and 58. The pins pass through tabs 60 and 62 that are connected to the projections 44 and 50 respectively. Thus each end of the spreader is pivotally connected to one of the contact numbers. When mounted between two corner walls, the edges of the contact members that are closed to the corner are spaced away from the corner to allow each contact member to pivot to a position that is parallel to the adjacent wall.

Figure 3:
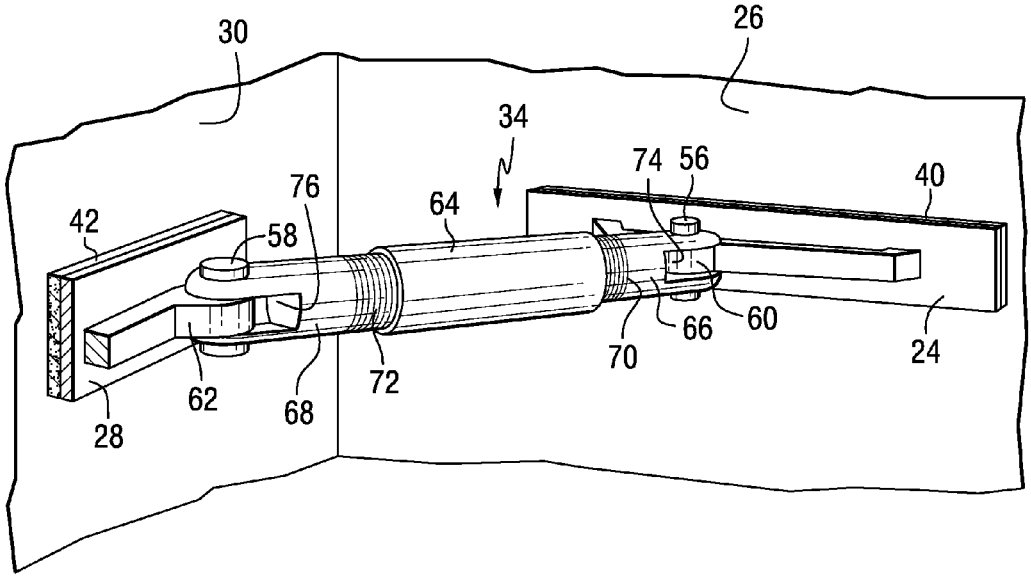
FIG. 3 is an isometric view of the support bracket of FIG. 2 mounted between two walls.

FIG. 3 is an isometric view of the support bracket of FIG. 2 mounted between two walls. The spreader 34 includes a sleeve 64 and first and second tubes or rods 66, 68. At least a portion 70 of the first rod is threaded, and at least a portion 72 of the second rod is threaded. The sleeve includes internal threads that are configured to engage the threaded portions of the rods. The threads on rod 66 have an orientation that is opposite to the orientation of the threads on rod 68. For example, rod 66 can include right hand threads, while rod 68 can include left hand threads, such that when the threaded portions of the rods are positioned within the sleeve, rotation of the sleeve will either force the rods apart or move the rods toward each other. When the rods are forced apart, the spreader applies a force to the contact members that urges the contact members toward the walls, and thereby presses the adhesive pads against the walls. The adhesive has sufficient strength to prevent slippage of the contact members in a direction away from the corner. Tab 60 fits within a slot 74 at the end of rod 66. Tab 62 fits within a slot 76 at the end of rod 68. These slots provide sufficient clearance that allows the contact members to pivot such that the outer surfaces of the contact member can lie parallel the to the adjacent support surface.

Figure 4:
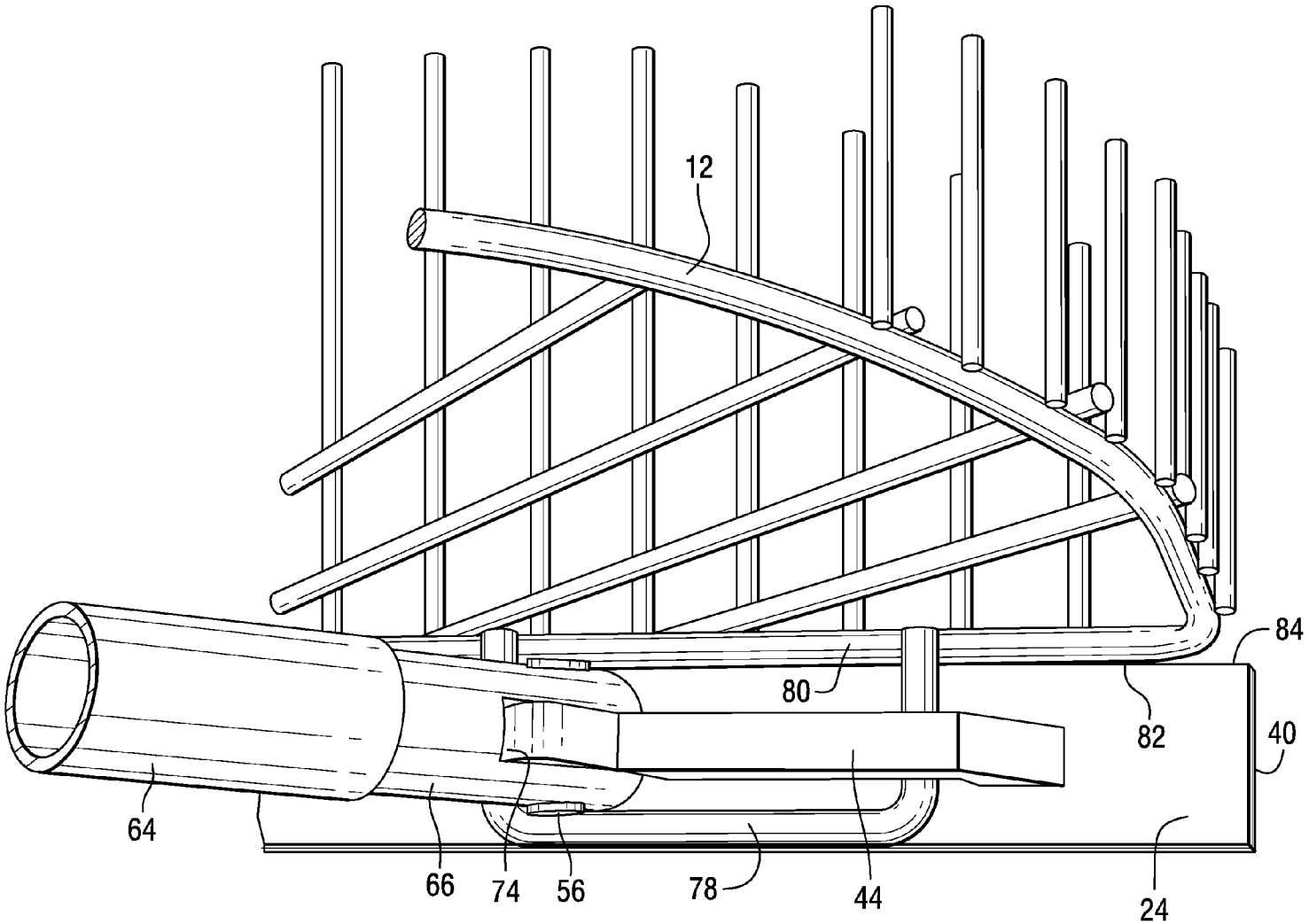
FIG. 4 is an isometric view of portions of the support bracket and the basket of FIG. 1.

FIG. 4 is an isometric view of portions of the support bracket and the basket. The basket is shown to include a structure that extends from the sides and is used to couple sides of the basket to the mounting bracket. In one embodiment, this structure comprises a mounting finger in the form of a U-shaped wire loop 78 that fits within the slot in the contact member 24. The wire loop is connected to an inner surface 80 of a bottom wire 82 of the basket 12. When the wire loop is fully inserted into the slot, the bottom edge of a side on the basket (in this example, a bottom edge of wire 82) rests on a top surface 84 of the contact member 24.

Figure 5:
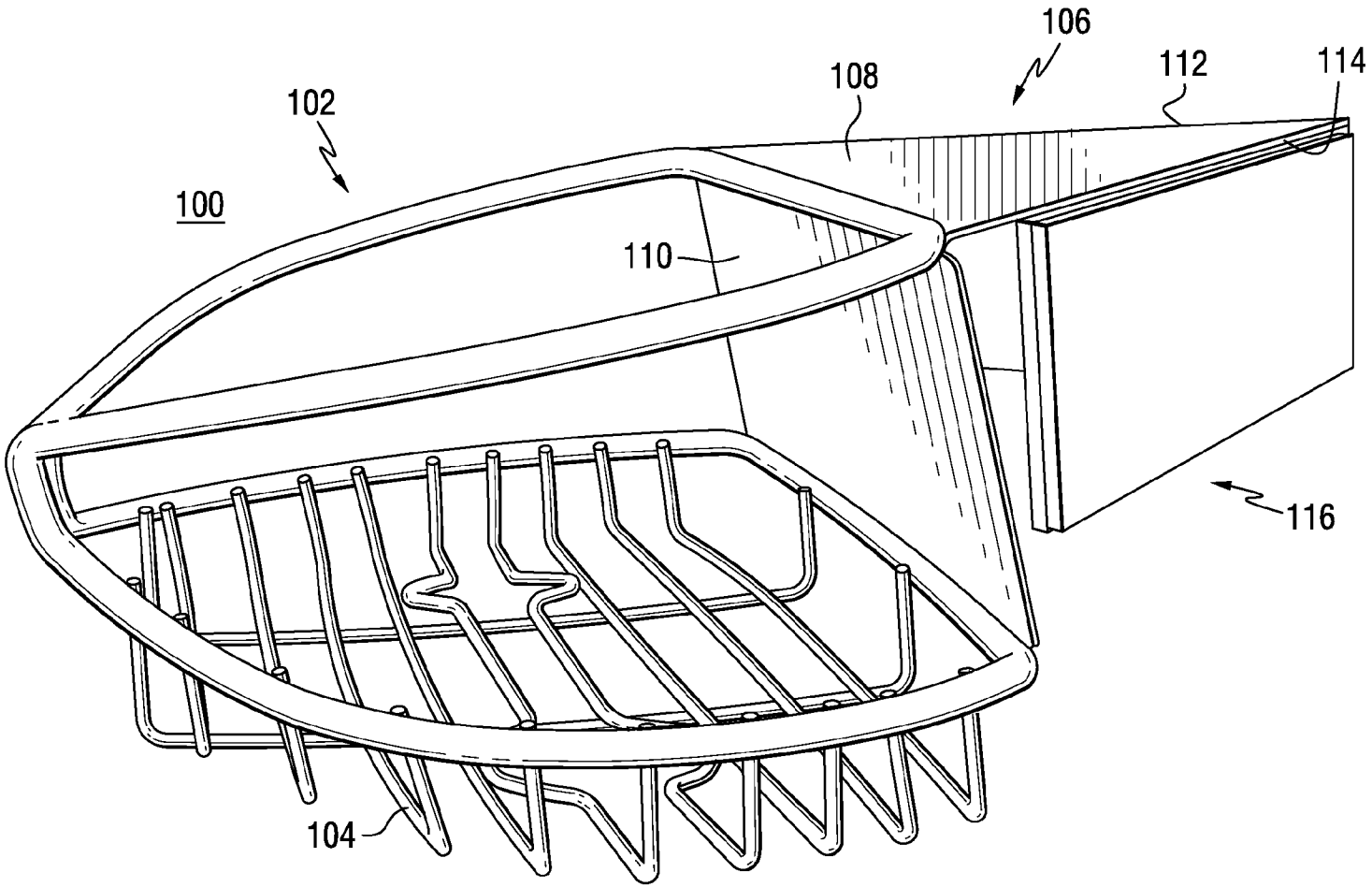
FIG. 5 is a perspective view of another embodiment of the invention.

FIG. 5 is a perspective view of another caddy 100 constructed in accordance with an embodiment of the invention. In this embodiment, the caddy includes a basket assembly 102 including a wire frame basket 104 connected to a structure 106 having a generally triangular top portion 108 and a front portion 110. Edges 112 and 114 of the top portion are positioned at substantially a right angle with respect to each other. When the caddy is mounted adjacent to a corner between two supporting surfaces or walls (not shown), the edges of the top portion can be positioned adjacent to the walls. The top portion is supported by a bracket 116, more fully shown in FIG. 6.

Figure 6:
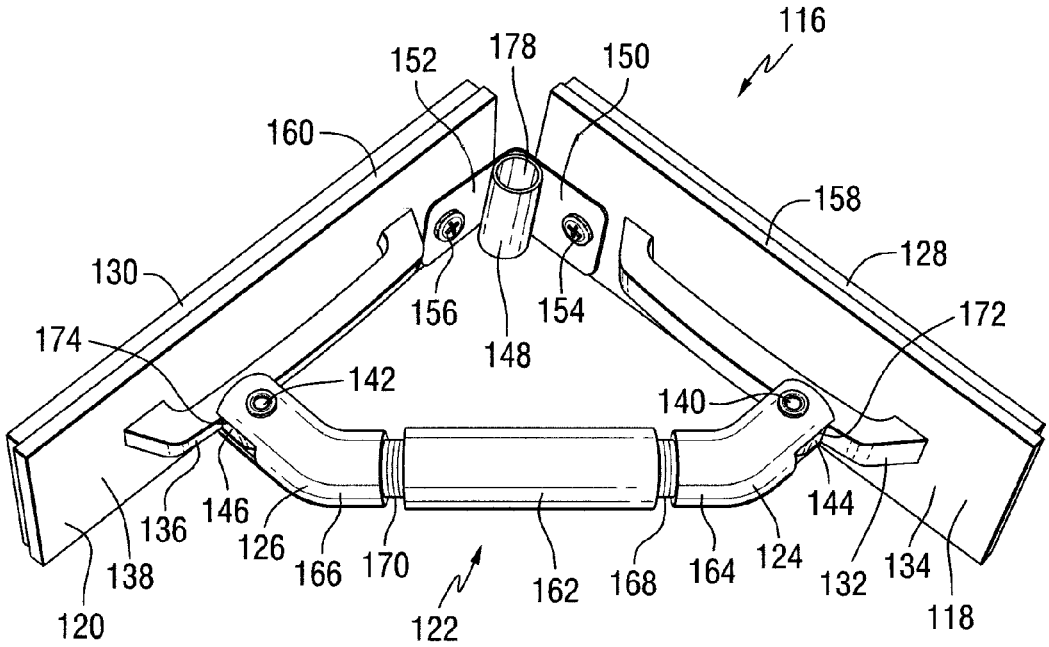
FIG. 6 is a perspective view of the support bracket of the embodiment of FIG. 5.

As shown in FIG. 6, the bracket 116 includes a first contact member 118 configured to be positioned adjacent to a first supporting surface or wall and a second contact member 120 configured to be positioned adjacent to a second supporting surface or wall. The walls can be positioned at substantially a right angle with respect to each other to form a corner as shown in FIG. 1. A tightening mechanism, referred to as a spreader or expansion member, 122 extends between the contact members. A first end 124 of the spreader is pivotally connected to the first contact member 118 and a second end 126 of the spreader is pivotally connected to the second contact member 120. A first adhesive, which in this embodiment comprises a first resilient adhesive pad 128, is positioned on an outer surface of the first contact member 118 such that the first resilient adhesive pad is positioned adjacent to a first wall. A second adhesive, which in this embodiment comprises a second resilient adhesive pad 130 is positioned on an outer surface of the second contact member 120 such that the second resilient adhesive pad is positioned adjacent to a second wall.

The first contact member 118 is shown to include a projection 132, extending from an inner surface 134 of the first contact member. The second contact member is shown to include a projection 136 extending from an inner surface 138 of the second contact member. The spreader 122 is connected between pins 140 and 142. The pins pass through tabs 144 and 146 that are connected to the projections 132 and 136 respectively. Thus each end of the spreader is pivotally connected to one of the contact numbers.

The bracket further includes means for coupling the bracket to the basket assembly. In this embodiment, the coupling means includes a tube 148 mounted between the first and second contact members. In this embodiment, the tube is connected to flanges 150, 152 that are attached to contact members by fastening means in the form of screws 154, 156. However other fastening means could be used, such as welds. When mounted between two corner walls, the ends 158, 160 of the contact members can be positioned adjacent to the corner formed by the walls.

The spreader 122 includes a sleeve 162 and first and second tubes or rods 164, 166. At least a portion 168 of the first rod is threaded, and at least a portion 170 of the second rod is threaded. The sleeve includes internal threads that are configured to engage the threaded portions of the rods. The threads on rod 164 have an orientation that is opposite to the orientation of the threads on rod 166. For example, rod 164 can include right hand threads, while rod 166 can include left hand threads, such that when the threaded portions of the rods are positioned within the sleeve, rotation of the sleeve will either force the rods apart or move the rods toward each other. When the rods are forced apart, the spreader applies a force to the contact members that urges that contact members toward the walls, and thereby presses the adhesive pads against the walls. The adhesive has sufficient strength to prevent slippage of the contact members in a direction away from the corner. Tab 144 fits within a slot 172 at the end of rod 164. Tab 146 fits within a slot 174 at the end of rod 166. These slots provide sufficient clearance that allows the contact members to pivot such that the outer surfaces of the contact member can lie parallel the to the adjacent support surface.

Figure 7:
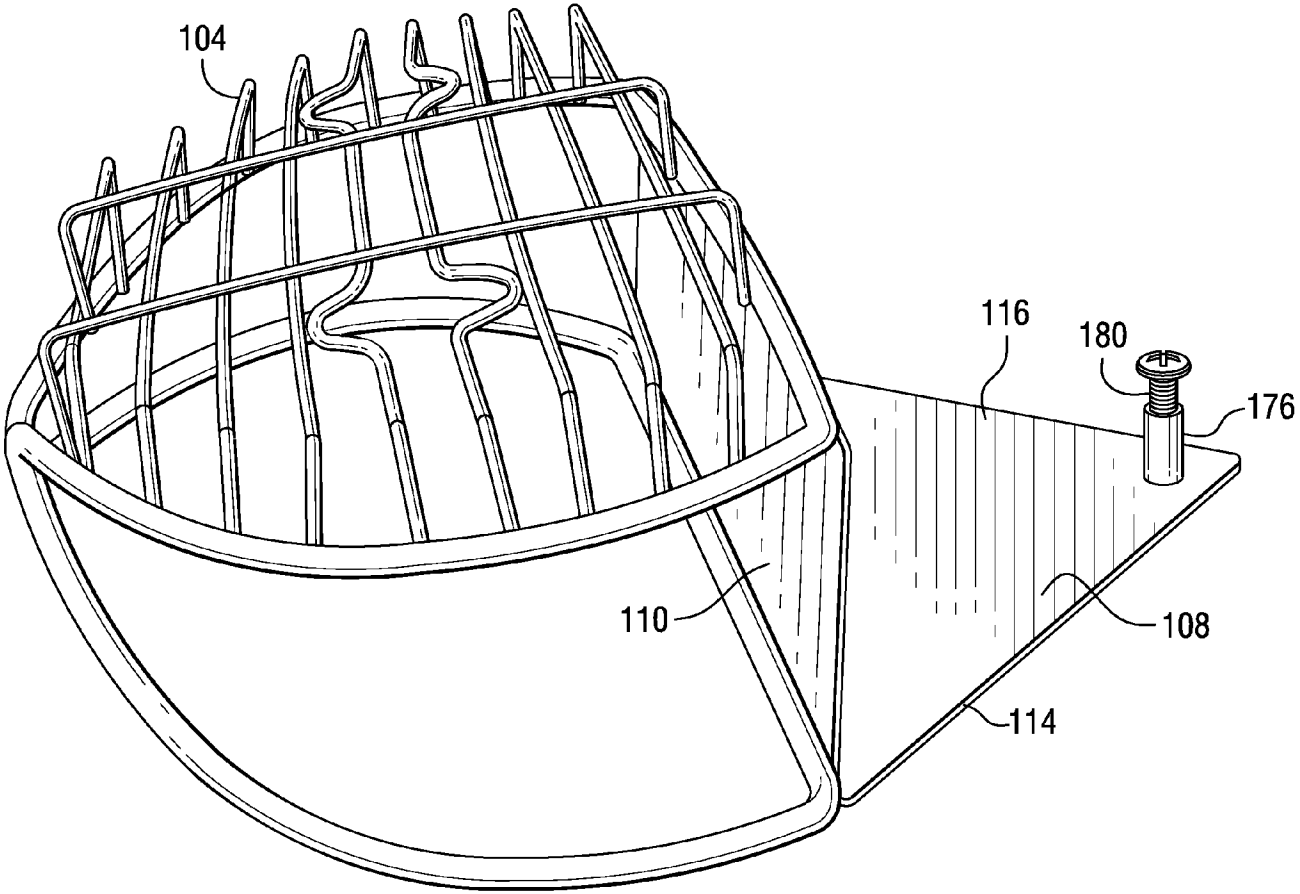
FIG. 7 is a perspective view of the basket assembly of FIG. 5.

FIG. 7 is an isometric view of portions of the basket assembly of FIG. 5. FIG. 7 shows a projection 176 connected to the top portion 108. This projection fits within an opening 178 formed by the tube 148 and in this embodiment includes internal threads to accept a bolt 180. The bolt is inserted into the projection to secure the top portion to the support bracket. While this embodiment shows a bolt as a fastening means, other types of fasteners can be used to secure the projection within the tube, or the projection itself can be structured to fit securely within the tube. Such other types of fasteners include, but are not limited to, clips, screws, etc. This coupling arrangement allows for easy removal of the basket assembly for cleaning. It also prevents the basket from tipping up or outward and thus stabilizes the position of the basket assembly. In addition, edges 112, 114 of the top portion can then rest on top edges of the contact members.

Figure 8:
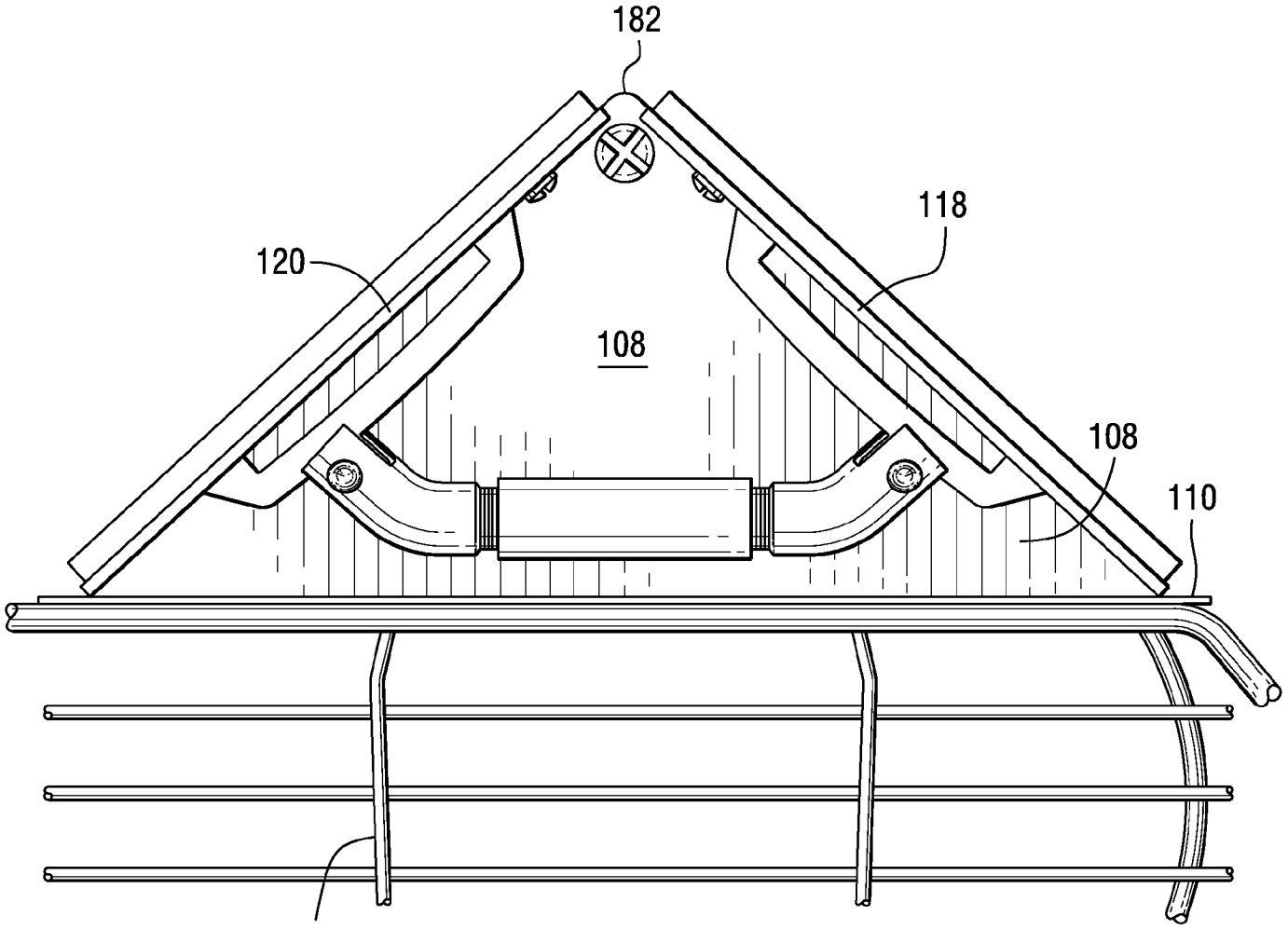
FIG. 8 is a bottom view of the support bracket portion of the embodiment of FIG. 5.

FIG. 8 is a bottom view of the support bracket portion of the embodiment of FIG. 5. When the caddy is to be attached between two walls, an apex 182 of the top portion is positioned adjacent to a corner formed by the walls, and the spreader sleeve can be rotated to force the adhesive pads on the contact members against the walls. The flange assembly that holds the tube is flexible enough to allow for some movement of the contact members toward the walls.

As shown and described in the figures, the disclosed embodiments of the corner caddy include a support bracket for mounting adjacent to a corner of a bath or shower stall. The support bracket includes wall contact members and a tightening mechanism. The wall contact members each comprise a wall contact surface which, in the embodiments shown, comprises an adhesive pad. Each adhesive pad can be an adhesive layer and may have a removable sheet that can be peeled from the adhesive layer for installation of the bracket. The mounting bracket is configured to support the corner caddy basket. In one embodiment, each contact member can include an open slot through which at least one portion of the basket may be inserted. In another embodiment, the mounting bracket includes means for coupling the basket assembly to the mounting bracket. As also shown in the figures, a tensioning mechanism is connected between the contact members, and is used to apply a force which presses the contact members against the walls. The tensioning mechanism as shown includes two rods or tubes oppositely threaded on their exterior surfaces, and an internally threaded sleeve. Rotation of the sleeve in one direction causes the oppositely threaded rods to move axially away from each other, while rotation of the sleeve in the opposite direction draws the threaded rods axially toward each other. The opposite ends of the rods are each pivotally attached to their respective contact member to allow some degree of relative movement therebetween, for example, to allow for variations from a 90° corner angle of the shower or bath stall.

In accordance with the embodiments shown in the figures, the corner caddy support utilizes a combination of adhesive strips and a tension adjuster in order to hold up the caddy. While adhesive strips or pads are preferred, other attachment means may be used in combination with, or as replacements for, the adhesive strips or pads. For example, high-friction tacky materials and the like may be used in addition to, or as replacements for, the adhesive strips or pads. While the mechanical tightening device shown in the figure comprises two oppositely threaded tubes and a threaded sleeve, any other suitable mechanical tightening device may be used, such as telescoping rods that may be mechanically fastened together with Allen screws or other mechanical fasteners, and the like.

With the described embodiments, no screws are required for installation of the corner caddy. In various embodiments, the caddy can be installed in minutes, and can hold at least 20 lbs of weight.

The caddy can be made from any suitable materials such as metal or plastic. For example, stainless steel or other non-corrosive metals such as chrome, nickel, brass and the like may be used.

Whereas particular embodiments of this invention have been described above for purposes of illustration, it will be evident to those skilled in the art that numerous variations of the details of the present invention may be made without departing from the invention.

What is claimed is:

1. A corner caddy comprising:

a basket assembly including a basket and a structure having a generally triangular top portion, a front portion, and a projection connected to the top portion, wherein the basket is connected to the front portion; and a bracket configured to be coupled to the basket assembly and including:

a first contact member pivotally connected to a first end of a spreader, a second contact member pivotally connected to a second end of the spreader, a first adhesive layer adjacent to an outer surface of the first contact member, a second adhesive layer adjacent to an outer surface of the second contact member; and a tube mounted between the first and second contact members, wherein the projection fits within an opening in the tube.

2. The corner caddy of claim 1, wherein edges of the generally triangular top portion are positioned at substantially a right angle with respect to each other.

3. The corner caddy of claim 1, wherein the first and second adhesive layers comprise resilient pads.

4. The corner caddy of claim 1, further comprising a first flange connecting the tube adjacent to a first end of the first contact member and a second flange connecting the tube adjacent to a first end of the second contact member, wherein the tube is oriented substantially perpendicular to the top portion.

5. The corner caddy of claim 1, wherein the projection has a generally cylindrical shape.

6. The corner caddy of claim 1, further comprising a bolt configured to screw into an end of the projection.

7. The corner caddy of claim 1, wherein the projection extends from a location adjacent to an apex of the top portion.

8. The corner caddy of claim 6, wherein the top portion includes first and second edges that are positioned at substantially a right angle with respect to each other.

9. The corner caddy of claim 8, wherein the first edge is positioned adjacent to a top surface of the first contact member and the second edge is positioned adjacent to a top surface of the second contact member.

10. The corner caddy of claim 1, wherein the spreader comprises:

a first rod having a threaded portion;

a second rod having a threaded portion;

a sleeve having an internal threaded portion configured to couple to the threaded portions of the first and second rods, wherein an orientation of the threaded portion of the first rod is opposite to an orientation of the threaded portion of the second rod.

11. The corner caddy of claim 10, further comprising:

a first pin coupling an end of the first rod to a first tab on the first contact member; and a second pin coupling an end of the second rod to a second tab on the second contact member.

12. The corner caddy of claim 11, wherein the first tab is connected to a first projection on the first contact member; and the second tab is connected to a second projection on the second contact member.

13. The corner caddy of claim 1, wherein the first adhesive layer comprises a first adhesive strip, and the second adhesive layer comprises a second adhesive strip.

14. The corner caddy of claim 1, wherein the first adhesive layer comprises a first high-friction tacky material, and the second adhesive layer comprises a second high-friction tacky material.

15. The corner caddy of claim 1, further comprising:

a first projection mounted on an inner surface of the first contact member and forming a first slot between the first projection and the inner surface of the first contact member, wherein the first end of the spreader is pivotally connected to the first projection; and a second projection mounted on an inner surface of the second contact member and forming a second slot between the second projection and the inner surface of the second contact member, wherein the second end of the spreader is pivotally connected to the second projection.

* * * * *